United States Patent [19]

Gambardella

[11] 4,201,357

[45] May 6, 1980

[54] FRAMEWORK FOR A BOX KITE

[76] Inventor: Harry N. Gambardella, 388 Main St., East Haven, Conn. 06512

[21] Appl. No.: 930,533

[22] Filed: Aug. 2, 1978

[51] Int. Cl.[2] ..... B64C 31/06

[52] U.S. Cl. ..... 244/153 R

[58] Field of Search ..... 244/153 R, 154; D34/15 AF

[56] References Cited

U.S. PATENT DOCUMENTS

| | | | |
|---|---|---|---|
| 605,596 | 6/1898 | Clayton | 244/153 R |
| 607,129 | 7/1898 | Potter | 244/153 R |
| 2,533,570 | 12/1950 | Foy | 244/153 R |

FOREIGN PATENT DOCUMENTS

| | | | |
|---|---|---|---|
| 856083 | 11/1970 | Canada | 244/153 R |

*Primary Examiner*—Barry L. Kelmachter

*Attorney, Agent, or Firm*—DeLio and Montgomery

[57] ABSTRACT

A box-type kite constructed of unitary polygonal end frames having interior corners and with passages in the interior corners subtending more than 180°. Struts carrying sails thereon and equal in number to the corners, having a cross-sectional dimension greater than the openings to the passages are received in the passages to provide a polygonal box-type kite which requires no cross bracing for rigidity.

5 Claims, 5 Drawing Figures

FRAMEWORK FOR A BOX KITE

This invention relates to kites and more particularly relates to kites of three-dimensional configuration which are often referred to as "box kites".

Kites referred to as "box kites" generally take a four-sided form. Such kites generally comprise four struts which are internally braced with diagonal internal braces which engage diagonally disposed struts to attempt to maintain rigidity of the kite when in box form.

The diagonal bracing generally comprises somewhat resilient members, usually wood, which are bowed in an operative position to exert equal and opposite forces on the four struts and maintain the overall kite in an operative position. Disposed around the struts at either end of the kite is a web material which circumferentially encloses either end of the kite and acts as an air foil, sometimes referred to as "sails".

Such constructions are exemplified in U.S. Pat. Nos. 2,873,077 and 3,711,045. Some constructions propose an internal spring bracing, as shown in U.S. Pat. No. 2,783,958.

The present invention provides a new and improved kite of the box type which does not require any diagonal cross bracing, yet insures an essentially rigid box-type kite construction which is easily assembled, and which may be easily disassembled for transportation after flying. Moreover, kites embodying the invention may be made in any polygonal form.

Briefly stated, the invention in one form thereof comprises two polygonal end members defining a plurality of corners. Defined in each of the corners is a passage adapted to receive a strut. These passages are partially open and subtend an angle greater than 180°. The struts with the sails thereon are quickly snapped into the passages in the end frames and compressively retained therein to provide a rigid box-like kite construction without the need for internal bracing. After flying, the struts may be easily snapped out of the passages. The struts and the sails are collapsed and the kite components easily transported.

An object of this invention is to provide a new and improved construction for a box-type kite which permits the kite to be made polygonal with any number of sides and without the necessity of any internal cross bracing.

It is another object of this invention to provide a new and improved construction for a box-type kite in which the kite may be easily assembled and disassembled.

The features of the invention which are believed to be novel are particularly pointed out and distinctly claimed in the concluding portion of this specification. The invention, however, both as to its organization and operation, together with further objects and advantages thereof may best be appreciated by reference to the following detailed description taken in conjunction with the drawing, wherein:

Figure 1:
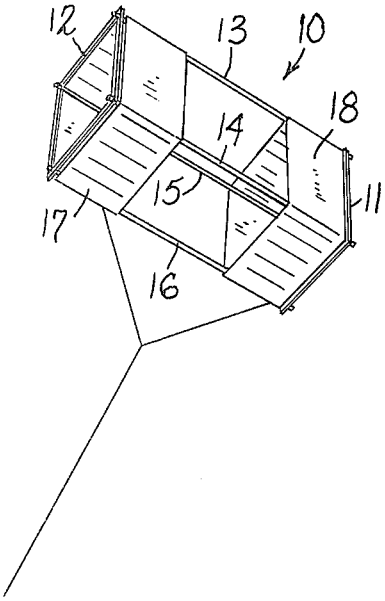
FIG. 1 is a view in perspective of a kite embodying the invention in flight.

As shown in FIG. 1, a kite 10 embodying the invention comprises a pair of polygonal end frames 11 and 12, and four struts 13–16, with sails of flexible web material 17 and 18 disposed about the struts at either end.

Figure 2:
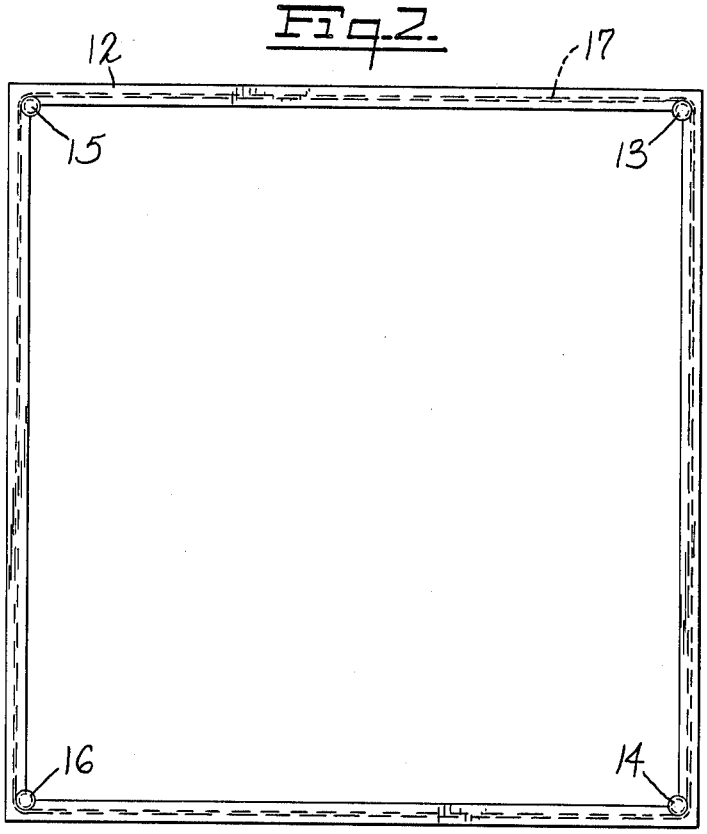
FIG. 2 is an end view of a kite embodying the invention.
Figure 3:
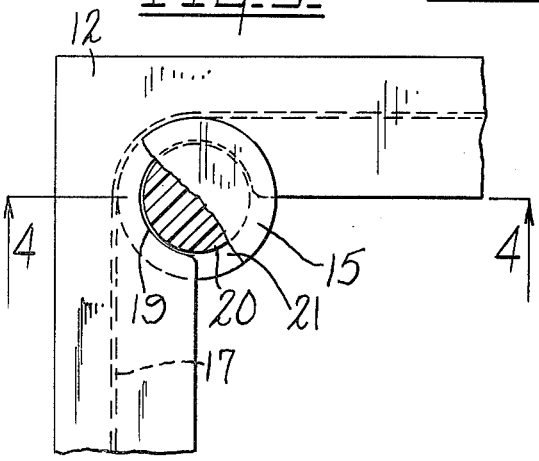
FIG. 3 is an enlarged end view partially cut away of a corner of a kite embodying the invention.
Figure 4:
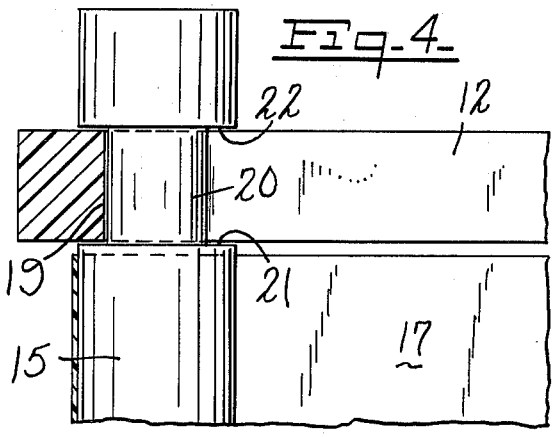
FIG. 4 is a view seen in the plane of lines 4—4 of FIG. 3.

Referring to FIGS. 2–4, the end frames 12 and 11 are formed frames, preferably molded of a lightweight plastic, such as styrene, and have some resilience. A plurality of passages are formed in the frame, one at each corner, and as shown in FIg. 3, such passage 19 is defined on a radius and subtends more than 180°, while having a corner opening. The opening to the passage 19 at the interior corners is of lesser dimension than the diameter of the portion of the strut 15 received therein. The strut 15, as shown in FIG. 4, as well as the other struts, preferably are formed with an undercut shoulder 20 adjacent the end. The diameter at the undercut is greater than the dimension across the opening to passages 19. With this dimensioning, and the resilience of the material of the polygonal end frames 11 and 12, the struts may be snapped into the passages 19 and compressively held therein.

The struts adjacent their ends may be formed with the undercut shoulders 20 defining spaced apart surfaces 21 and 22 which will overlie the frames 11 and 12 about passages 19 and prevent any axial motion of the struts with respect to the end frames. If the construction of FIGS. 3 and 4 is utilized, the edges defining opening 19 need not compressively engage the periphery of the struts. The diameter of the struts at 19 need only be large enough so that they would not unintentionally come out of the opening to the passages 19.

The sails may be attached to the individual struts by any suitable manner, such as adhesive around the contacting portion of the periphery of the struts, by staples, or any other suitable manner.

Figure 5:
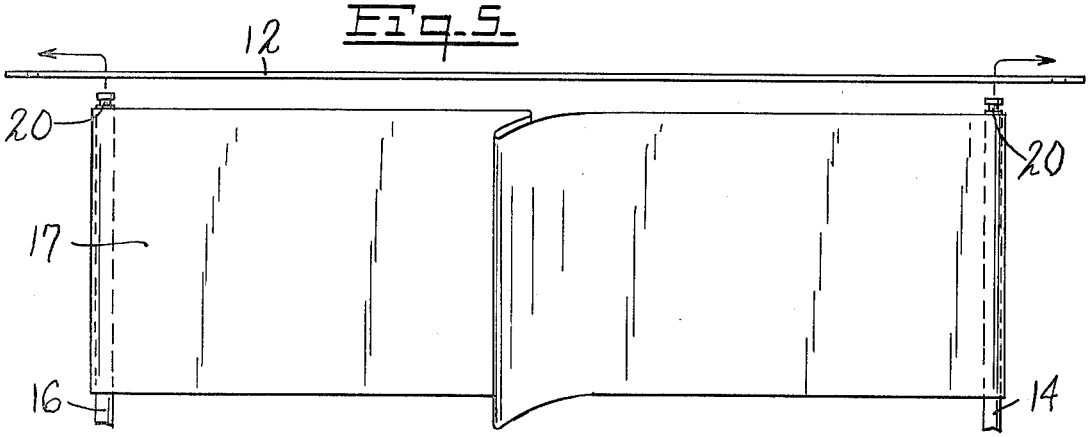
FIG. 5 is a view of a kite embodying the invention under assembly.

In assembly, the struts are inserted into the frames as exemplified in FIG. 5 and merely snapped into each corner passage. This construction assures a given dimensional relationship between the struts each time the kite is assembled. The dimension of the sails is selected to be such that the sail sections between adjacent struts will be adequately tensioned upon assembly.

It will be apparent with a kite construction using the disclosed polygonal end frames, which are substantially rigid but have some resilience, a box-type kite may be formed with any desired number of sides; for example, three, five, six, etc., without the need for any cross bracing or other internal tensioning or spacing devices.

It will further be understood that the polygonal end frames could be formed with the corner passages on the exterior corners. However, this is not desirable unless the sails are made of a stretchable material. If the sail material is not stretchable and somewhat resilient, then undesired slack may result in the sail area between adjacent struts.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. A box-type kite comprising first and second formed unitary polygonal end frames having corners, a plurality of struts equal in number to said corners, flexible sails disposed about said struts intermediate the ends of the struts, strut receiving passages defined in said frames at each of said corners and subtending more than 180°, and having openings for insertion of said struts therein, said struts having a cross-sectional dimension greater than the openings to said passages, said struts received in said passages in each of said frames adjacent the ends of said struts, said frames being sufficiently resilient so that said struts may be inserted in said passages through said openings and held therein.

2. The kite of claim 1 wherein said struts have undercut shoulders adjacent the ends thereof, said struts being received in said passages with the edges defining said shoulders preventing axial movement of said struts therein.

3. The kite of claim 1 wherein said passages are defined on a radius, and said struts have substantially the same radius.

4. The kite of claim 1 wherein said end frames are rectangular.

5. The kite of claim 1 wherein said passages are defined in the interior corners of said frames.

* * * * *